US006162137A

United States Patent [19]

Jones et al.

[11] Patent Number: 6,162,137

[45] Date of Patent: Dec. 19, 2000

[54] MULTIPLE-USE HAND TOOL FOR GOLFERS

[76] Inventors: Todd Jones, 805 Leland Pl., El Cajon, Calif. 92020; Greg Bark, 11215 Forest View La., San Diego, Calif. 92131

[21] Appl. No.: 09/317,299

[22] Filed: May 24, 1999

[51] Int. Cl.[7] ..... A63B 57/00; B26B 11/00

[52] U.S. Cl. ..... 473/408; 7/158; 30/109

[58] Field of Search ..... 7/158; 30/109, 30/112, 151, 153, 155, 159, 160, 161; D21/793; 473/278, 408

[56] References Cited

U.S. PATENT DOCUMENTS

| | | | |
|---|---|---|---|
| 899,407 | 9/1908 | Kampfe | 30/112 |
| 899,408 | 9/1908 | Kampfe | 30/112 |
| 1,111,743 | 9/1914 | Graboff | 30/112 |
| 4,063,731 | 12/1977 | Kitay . | |
| 5,143,371 | 9/1992 | Strahan . | |
| 5,405,133 | 4/1995 | Upton . | |
| 5,449,169 | 9/1995 | Hardin et al. | 473/408 |
| 5,730,404 | 3/1998 | Evans et al. . | |
| 5,819,750 | 10/1998 | Moyer . | |

*Primary Examiner*—Eileen P. Morgan
*Assistant Examiner*—Joni B. Danganan
*Attorney, Agent, or Firm*—Thomas J. Tighe

[57] ABSTRACT

A combination ball mark repair tool, golf club support and cigar cutter. The invention includes a prier for prying up ball marks which are depressions made particularly in golf greens by impacting golf balls. The prier includes a shank ending, in a pair of tines which are used to penetrate turf and pry up depressions in the turf. The prier is pivotally connected to an end of a handle for leverage, the handle defining a slot for retracting the prier. A push pin controls a detent which locks the shank in either a fully opened position or a fully retracted position. Depressing the push pin unlocks the shank. When the shank is unlocked, a torque spring urges the shank to pivot from its handle slot to its open position. The prier preferably has two tines to avoid damage to the turf. Inserting the tines into the turf at the edge of a ball mark and then pivoting the handle toward the surface causes the tines to raise the depressed turf, thereby repairing the ball mark. Opening the prier also provides access to a cigar cutter in a hole in a side of the handle. An annular recess surrounding the cutter allows the tip of a cigar to be pressed onto the cutter and twisted. By twisting the cigar, a shallow plug from the cigar's end is cut, allowing for easier drawing of smoke through the cigar. The end of the handle opposite the open prier defines a concave recess. With the tines of the prier stuck in turf so that the handle is generally vertical, a golf club shaft can be cradled in the recess, keeping the grip off the turf and preventing it from becoming wet from moisture on the grass.

14 Claims, 3 Drawing Sheets

MULTIPLE-USE HAND TOOL FOR GOLFERS

BACKGROUND OF THE INVENTION

This invention relates in general to small hand tools for golfers, and more particularly to multi-use tools which can repair marks made in golf greens by the impact of golf balls.

Golfers must travel long distances on golf courses as they sequentially play the holes. This usually means that once a golfer starts a round of golf, he or she will only be able to use the equipment, accessories and tools that he or she brings along. For this reason, golfers generally carry a multiplicity of clubs, balls, tees, and accessories to ensure their availability when needed. Therefore, a tool which can perform several golf-related functions but which is small and light is a desirable accessory for a golfer.

One feature of this invention is for repairing ball marks. When a long driven ball impacts the surface of a green it often makes a dent in the green, a depression in the grass and underlying ground, commonly called a "ball mark." Common courtesy and golfing protocol require that golfers repair their ball marks. This is usually done by poking an implement in the ground around and beneath the mark, and prying up the dent to make it level. Because of the heretofore lack of a handy little tool specifically designed for repairing ball marks, the implement most often used is a golf tee, which is not very satisfactory since it catches very little dirt and grass and must be used several times around the dent to even inadequately raise it.

This invention includes a tool specifically designed for repairing ball marks. It has a prier of suitable size and strength to raise a ball mark typically in a single try without damaging the turf. The prier is retractable into a handle for convenient storage in a golfer's pocket, and is deployed by the push of a button, similar to a switch-blade knife.

Another feature of this invention is for keeping a golf club's grip off wet grass. For a variety of reasons, golfers start teeing off very early in the morning, but one disadvantage of an early start is that golf courses are often still wet from condensation or watering during the night, causing anything laid down on the grass to become wet. This poses a problem when a golfer must lay down a club. For example near a green, golfers often leave their bag or cart near the next tee, and take a putter and a chipping iron to finish the hole. While making a chip or pitch shot, there is usually no place to put the putter except on the ground causing its grip to become wet. Then while putting, there is usually no place to put the chipping iron except on the ground causing its grip to also become wet. This is undesirable since grips can be damaged by moisture if not quickly dried. Also, a wet grip is a slippery grip.

The combination tool of this invention includes a cradle feature specifically designed for keeping a club grip off wet grass. A club's head can rest on the turf while its shaft leans on the cradle to keep the grip spaced from the turf.

Another feature is not limited to use on a golf course but does come in handy for golfers who smoke cigars. The combination tool of this invention further includes a cigar cutter. Usually at least one end of a cigar is covered by one or more protective tobacco leaves which must be penetrated to draw air through the cigar. The cigar cutting feature of this invention can be used to easily cut out a small plug from a cigar end, but again, the use of this tool to trim cigars is not limited to a golf course but can be used wherever desired.

Other advantages and attributes of this invention will be readily discernable upon a reading of the text hereinafter.

SUMMARY OF THE INVENTION

An object of this invention is to provide a small collapsible tool for repairing ball marks.

An additional object of this invention is to provide a ball mark repair tool including an efficient prier which minimizes damage to the turf.

An additional object of this invention is to provide a ball mark tool including a spring-operated prier which deploys automatically by the push of a button.

An additional object of this invention is to provide a ball mark tool including at least a pair of tines of sufficient size and strength to quickly repair ball marks without damaging the turf.

An additional object of this invention is to provide a ball mark tool which includes a feature for propping a golf club grip above the ground.

An additional object of this invention is to provide a ball mark tool which includes a cradle defined in its handle for propping a golf club grip above the ground.

An additional object of this invention is to provide a ball mark tool which includes a cigar cutter.

An additional object of this invention is to provide a cigar cutter disposed in a hole defined in the handle of a ball mark tool.

An additional object of this invention is to provide a cigar cutter in the handle of a golf accessory tool which will cut a shallow cylindrical plug out of the end of a cigar.

A further object of this invention is to provide a golf accessory tool which combines a ball mark repair tool, a club support and a cigar cutter.

These objects, and other objects expressed or implied in this document, are accomplished by a device for repairing a ball mark having a handle and a prier for being inserted into turf in which the ball mark is defined. The prier is movable between two operable positions, a first position at which the prier is retracted, i.e., folded into the handle, and a second position at which the handle can be used to leverage the prier to pry up the turf. The device also includes a mechanism for releasably locking the prier at either position. Preferably the prier includes a shank and a plurality of tines projecting therefrom for insertion into turf. Preferably the prier is pivotable between the two operable positions, and the handle defines a slot into which the prier is pivoted to be in its first position. The device also preferably includes a torque spring for urging the prier to its second position whenever the prier is released from being locked in its first position. Preferably a detent locks the prier in either of its two operable positions when the detent is engaged, and the detent is disengaged in response to pressure from a user's finger or thumb. Preferably the detent is disengaged by a push pin in the handle, the pin being movable axially over a range and biased to reside at one extent of its range, the detent being engaged whenever the pin is at said one extent of its range and the prier is in one of its two operable positions. The device can also include a feature for spacing a leaning shaft of a golf club up from wet turf beneath. When the prier is in its second (fully opened) position it can be stuck generally vertically into the turf, and a concave recess defined by the handle on a side opposite the open prier can be used to cradle the shaft of a leaning golf club keeping it off wet grass below. The device can further include a recessed blade for cutting an end of a cigar. Preferably a depression is defined by the handle, the depression being large enough in girth for an end of a cigar to press against a base of the depression, and a circular cutting blade is affixed to the base of the depression. Preferably the depression intersects the prier slot, and the prior blocks access to the cutting blade whenever the prior is in its first (retracted) position.

DESCRIPTION OF THE PREFERRED EMBODIMENT

Figure 1:
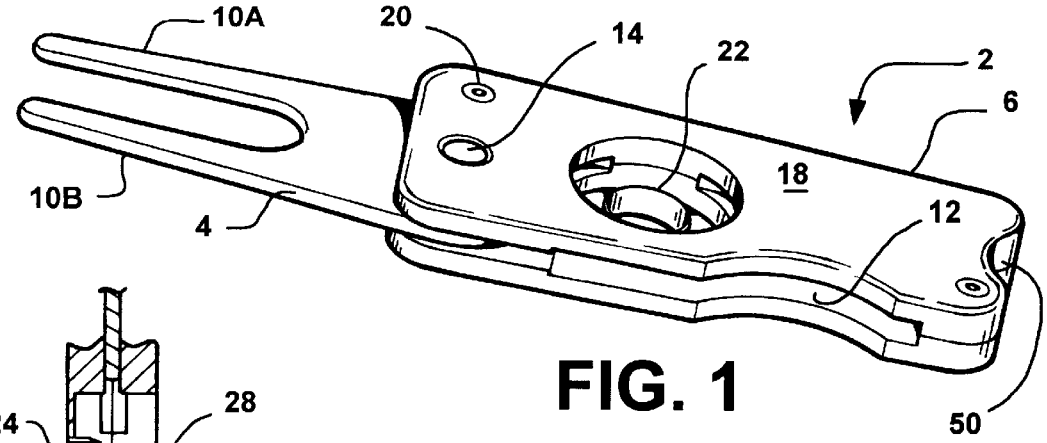
FIG. 1 is a pictorial view of the invention.
Figure 4:
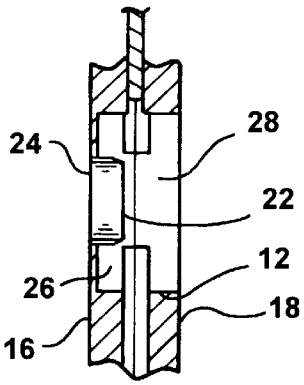
FIG. 4 is a cross-sectional view along the line 4—4 of FIG. 2.
Figure 3:
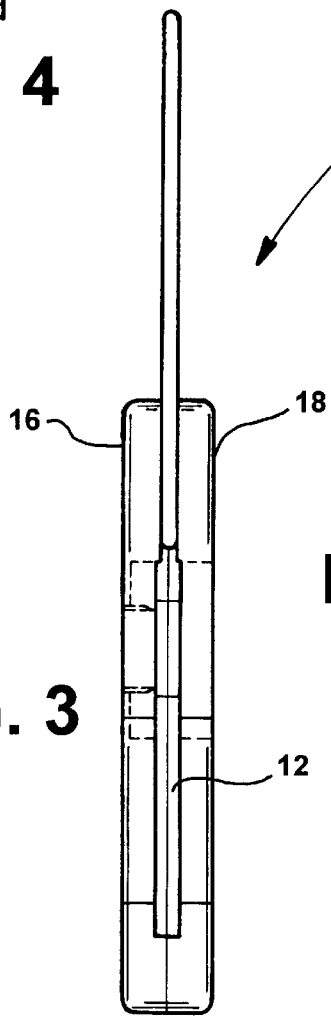
FIG. 3 is an elevation view of FIG. 2.
Figure 2:
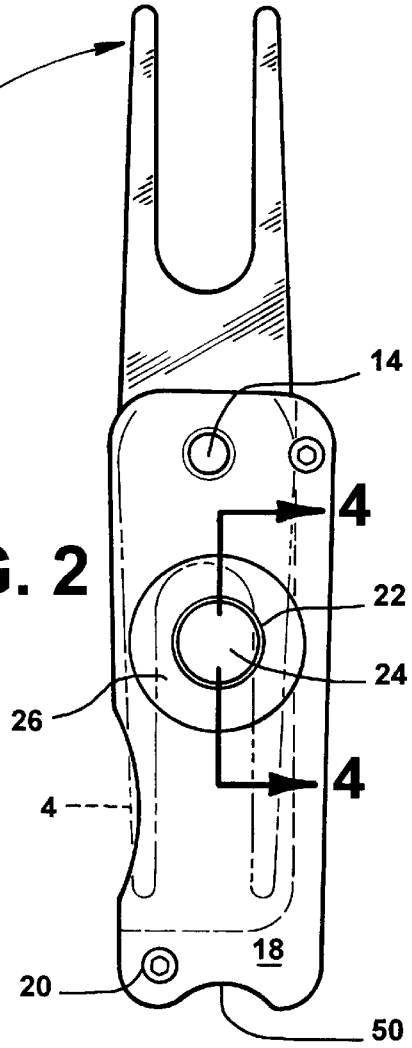
FIG. 2 is a plan view of FIG. 1.

Referring to the FIGS. 1–4, a combination ball mark repair tool, club support and cigar cutter, generally designated 2, is illustrated to include a prier, shown in a fully opened position, for prying up a ball mark. The illustrated prier has a shank 4 pivotally connected to a handle 6, and a pair of tines, 10A and 10B, integral with the shank and extending therefrom at an end opposite the handle. The prier can pivot between a retracted position, in which it is fully inside a slot 12 defined by the handle, and a fully opened position in which it is out of the slot and locked in alignment with the handle, as shown in FIGS. 1–3. A fully retracted prier is shown in phantom in FIG. 2. Retraction of the prier allows the tool to be easily stored or carried. The prier's shank 4 turns on an axis concentric with a push pin 14 disposed at one end of the elongated handle 6. The top of the pin is exposed on one side of the handle so that it can be depressed axially, e.g. pushed down by a user's finger or thumb, to unlock the shank. Preferably the top of the push pin is flush with the handle. When depressed, the push pin is biased to return to a normal, undepressed position, and when the pin is in its normal position the shank is locked in place at either of two positions: fully opened or retracted.

Referring again to the figures, the handle 6 is preferably assembled from a pair of mating sides, a back side 16 and a front side 18, each having congruent outlines. The designation of the sides is an arbitrarily chosen directional reference, the "front side" 18 corresponding to the side on which the push pin is exposed. The sides are preferably joined by fasteners 20, preferably Allen screws disposed in recessed holes in one side and mating with threaded, blind holes in the other side.

Figure 5:
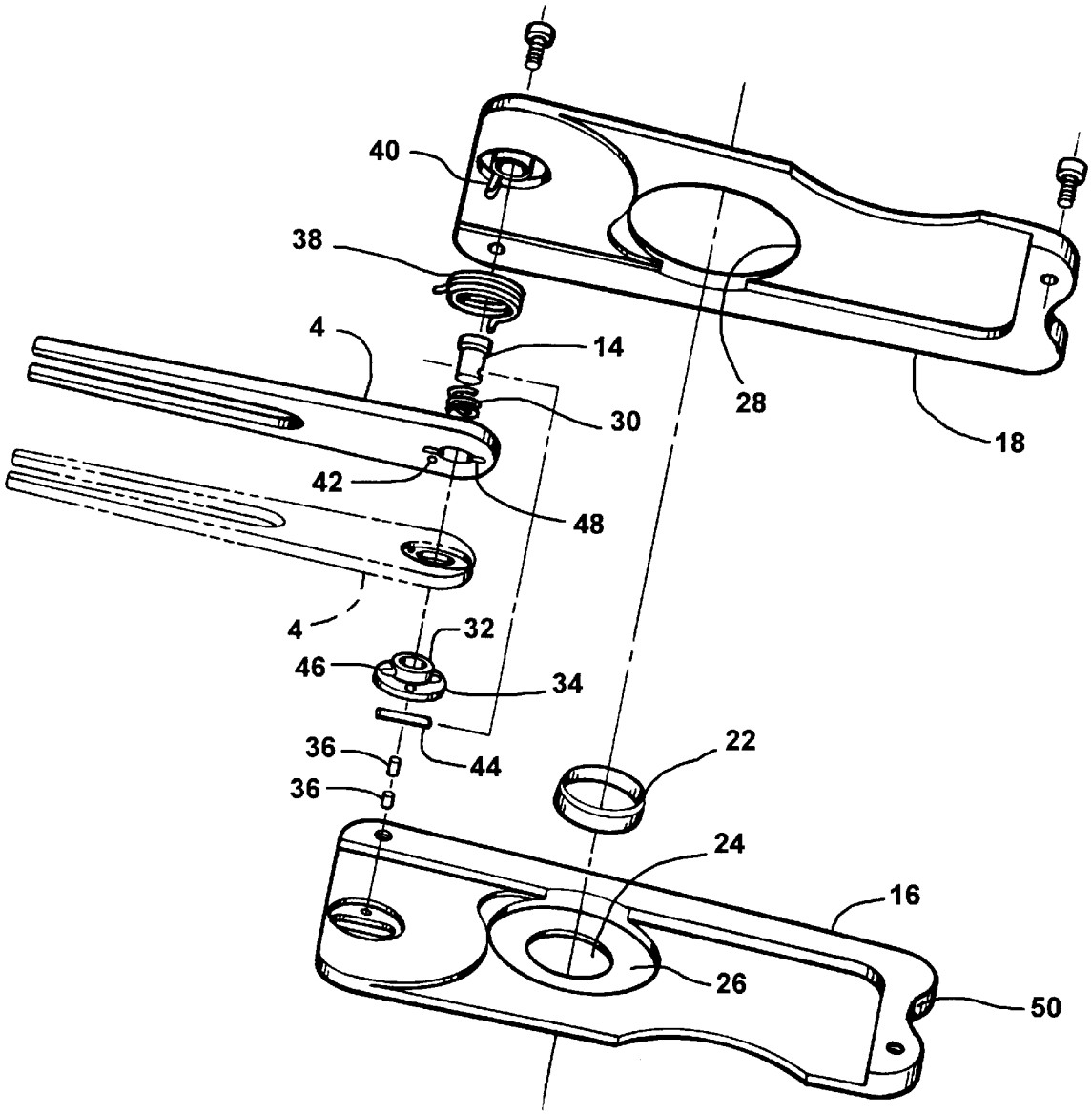
FIG. 5 is an exploded view including a view of both sides of a prier, one in solid lines and the other in phantom lines.
Figure 6:
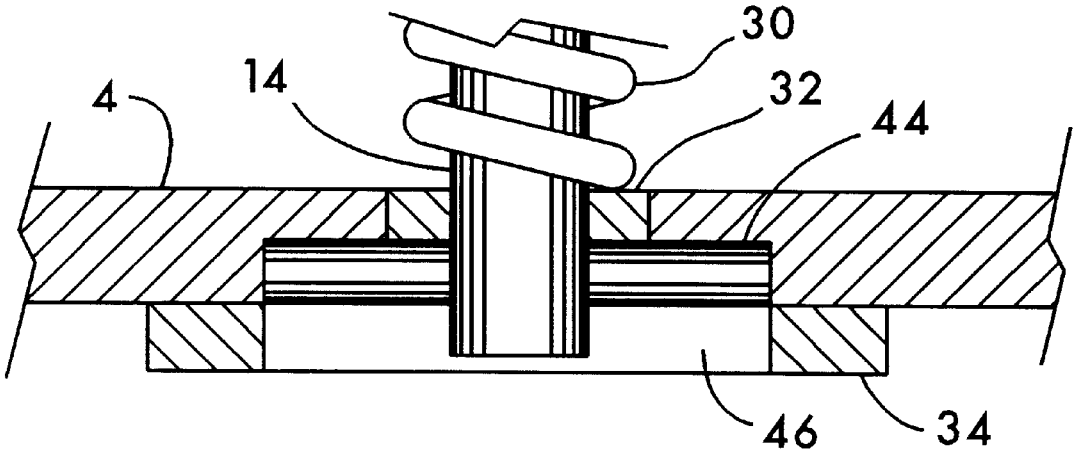
FIGS. 6 and 7 are partial cross-sections respectively taken along a detent median and illustrating locked and unlocked shanks.
Figure 7:
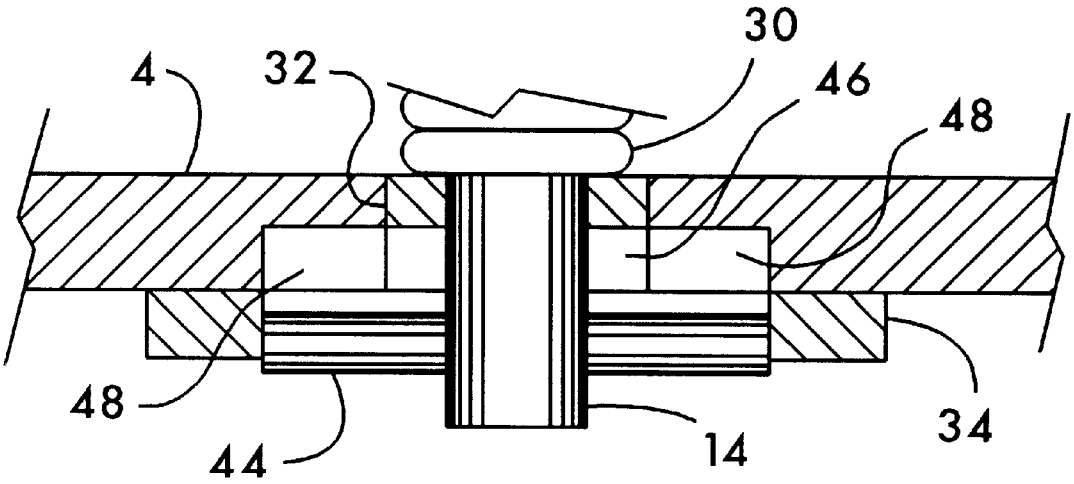

Referring to FIGS. 5–7, a compression spring 30 is disposed around the push pin 14, in an annular space defined by the handle 6, to resist depression of the pin. The shank 4 pivots on a cylindrical boss 32 extending centrally from a plate 34 which is affixed to a handle back side 16 by dowels 36. The boss and the plate define a central through-hole through which the push pin extends. A coiled spring 38 disposed in an annular space around the push pin gets wound tighter when the shank is retracted and exerts a torque on the shank urging the prier to be in the fully opened position. One end of the torque spring is fixed in place by hooking a tongue 40 extending from the handle front side, and the other end of the spring rotates with the shank because it resides in a hole 42 defined by the shank near its pivot point. When the push pin is released, a detent locks the shank when it is either fully opened or fully retracted.

Referring again to FIGS. 5–7, the detent is illustrated to include a rod 44 sticking through the push pin 14 near the pin's base and projecting normally therefrom on opposite sides. As the push pin is depressed and released, the protruding ends of the rod travel parallel to the shank pivot axis in a confining channel 46 defined by the plate 34 and its boss 32. The shank defines a rod seat 48 symmetrically intersecting the shank's pivot hole in which the boss 32 is disposed. When the push pin is released the rod is urged toward the shank and, if the rod seat 48 and the rod channel 46 are aligned, the rod will be seated in the rod seat while still being in the rod channel, as best illustrated in FIG. 6. Once seated, the rod will prevent the shank from further pivoting. Preferably the channel and seat will be aligned only when the shank is either fully opened or fully retracted. To unlock the shank, the pin 14 is pushed down until the rod is unseated, as best illustrated in FIG. 7, freeing the shank to pivot on boss 32. Once the shank is unlocked, the torque spring 38 urges it to swing out to its fully opened position if it was retracted, or force can be applied to retract the shank if it was opened. When the push pin is subsequently released, the detent re-locks the shank when the rod channel and rod seat again become aligned. The top of the push pin in its normal position is preferably flush with the outer surface of the handle which in the preferred embodiment is flat. Also, preferably the edge of handle hole surrounding the pin is outwardly beveled to provide more room for a person's thumb to adequately depress the pin to unlock the shank.

Referring to FIGS. 1–4, the base of a cylindrical cutting blade 22 is affixed to and around the margin of a circular hole 24 defined in the bottom of a concentric recess 26 defined in the handle's back side 16. The cutting edge of the blade faces a through-hole 28, congruent with recess 26, defined by the handle's front side 18. The hole 28 and recess 26 are sized in girth to allow an end of a cigar to pass through to be cut by the cutting blade 22. To use the cigar cutter, the pivot pin 14 is depressed by a user's digit, allowing the torque spring to open the prier. When the prier is retracted into its slot, the prier blocks the cutting blade 22. With the prier out of the way, the tip of a cigar can be pressed onto the cutting blade, causing the blade to cut into the cigar until the tip abuts the base of the annular recess 26. The cigar is then rotated axially and pulled out, leaving a shallow circular plug of tobacco inside the cutting blade which is easily extracted.

Referring to FIGS. 1 and 2, an end 50 of the handle 6 opposite the prier, when the prier is opened, is concave to act as a support cradle for a golf club grip. The cradle is generally centered in the end of the handle and preferably has a radius suitable to accommodate the grip end of a golf club shaft. The cradle is also deep enough to confine the shaft when the cradle is generally upright. In operation, a user opens the prier and sticks it in the ground so that the handle is generally vertical with the cradle facing upward. A golf club can then be propped up with its shaft or grip resting in the cradle, and thus supported above the turf. As previously explained, this is a convenient way for a golfer to lay a club down without getting the grip wet.

The ball mark prier is preferably made of hardened steel, allowing its tines to be inserted into the grass and soil repeatedly without becoming damaged. In addition to being hardened, the tines and shank are preferably sufficiently thick and/or strong enough to prevent the tines from bending while prying up ball marks. Although the shank can terminate in a shape other than tines (e.g. a blade or a shovel-like head), the tines are preferable for prying up depressed turf without significantly damaging it. They make small holes, are long enough to penetrate the turf deep enough to pry up a mark, and are spaced close enough to lever the depressed turf without ripping it apart.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

What is claimed is:

1. A device for repairing a ball mark in turf comprising:

(a) a handle, (b) means, connected to the handle, for prying up a ball mark in turf, the means for prying being pivotable between two operable positions, a first position at which said means is retracted into the handle and a second position at which the handle can used leverage to pry up the turf, and (c) means for releasably locking the means for prying at both positions.

2. The device according to claim 1 further comprising means for spacing a grip end of a golf club up from turf beneath said means for spacing being lockable in position.

3. The device according to claim 2 further comprising means for cutting a cylindrical plug out of an end of a cigar.

4. The device according to claim 2 wherein the means for spacing comprises:

(a) the means for prying being in its second position so that it can be generally vertically inserted into turf, and (b) cradle means, defined by the handle on a side opposite the means for prying, for vertically supporting the shaft of a leaning golf club.

5. The device according to claim 1 further comprising means for cutting a cylindrical plug out of an end of a cigar.

6. The device according to claim 5 wherein the means for cutting comprises:

(a) a depression defined by the handle, the depression being sized in girth for an end of a cigar to press against a base of the depression, and (b) a circular cutting blade affixed to the handle at the base of the depression.

7. The device according to claim 6 wherein the depression intersects the opening defined by the handle for the means for prying which blocks access to the cutting blade whenever the means for prying is in the opening.

8. The device according to claim 1 wherein the means for prying comprises an opening defined by the handle in which the means for prying is disposed when in its first position.

9. The device according to claim 8 wherein the means for prying comprises a shank and a plurality of tines projecting therefrom.

10. The device according to claim 8 further comprising means for urging the means for prying to its second position whenever the means for prying is released from being locked in its first position.

11. The device according to claim 10 further comprising:

(a) a detent for locking the means for prying in either of its two operable positions when the detent is engaged, and (b) means for disengaging the detent in response to pressure from a user's finger or thumb.

12. The device according to claim 11 wherein the means for disengaging, the detent comprises:

(a) a push pin movable axially over a range, and (b) means for biasing the pin to reside at one extent of its range, the detent being engaged whenever the pin is at said one extent of its range and the means for prying is in one of its two operable positions.

13. The device according to claim 12 wherein the means for urging the means for prying comprises a torque spring.

14. The device according to claim 1 further comprising means for urging the means for prying to its second position whenever the means for prying is released from being locked in its first position.

* * * * *

UNITED STATES PATENT AND TRADEMARK OFFICE

CERTIFICATE OF CORRECTION

PATENT NO : 6,162,137

DATED : December 19, 2000

INVENTOR(S) : Todd Jones and Greg Bark

It is certified that error appears in the above-identified patent and that said Letters Patent is hereby corrected as shown below:

In column 3, line 2, the word "prior" should be replaced with the word --prier--.

In column 3, line 3, the word "prior" should be replaced with the word --prier--.

In column 5, line 18, the word --for-- was omitted and should be added immediately after the word "used".

Signed and Sealed this

Eighth Day of May, 2001

*Attest:*

Nicholas P. Godici

NICHOLAS P. GODICI

*Attesting Officer*

*Acting Director of the United States Patent and Trademark Office*